US005974704A

United States Patent [19]

Grant

[11] Patent Number: 5,974,704

[45] Date of Patent: Nov. 2, 1999

[54] CORE-TYPE SNOW REMOVER

[76] Inventor: John Grant, 296 54A Street, South Delta, British Columbia, Canada, V4M 3J3

[21] Appl. No.: 08/738,615

[22] Filed: Oct. 29, 1996

[51] Int. Cl.[6] ..... E01H 5/02

[52] U.S. Cl. ..... 37/285; 37/195; 37/222

[58] Field of Search ..... 37/285, 219, 205, 37/197, 222, 223, 224, 195; 172/519; 56/400.02; 198/513

[56] References Cited

U.S. PATENT DOCUMENTS

| | | | |
|---|---|---|---|
| 712,315 | 10/1902 | Langworthy | 37/285 X |
| 993,739 | 5/1911 | Vickers | 37/285 |
| 2,171,075 | 8/1939 | Blazier | 37/285 X |
| 2,730,054 | 1/1956 | McDonald | 111/10 |
| 2,769,255 | 11/1956 | Mead | 37/43 |
| 2,854,808 | 10/1958 | Ramacher et al. | 56/400.02 |
| 2,966,948 | 1/1961 | Ulsh | 172/72 |
| 3,119,314 | 1/1964 | Schiel, Jr. | 172/537 |
| 3,220,369 | 11/1965 | Gandrud | 111/10 |
| 3,562,831 | 2/1971 | Kowalski | 56/400.02 X |
| 3,913,247 | 10/1975 | Ruhl | 37/43 E |
| 4,105,354 | 8/1978 | Bowman | 172/540 X |
| 4,145,823 | 3/1979 | Lucas | 37/219 |
| 4,346,526 | 8/1982 | Mattson et al. | 37/259 |
| 4,920,667 | 5/1990 | Dixon | 37/285 |
| 5,269,082 | 12/1993 | Sund et al. | 37/285 X |
| 5,540,004 | 7/1996 | Patterson et al. | 37/219 X |
| 5,581,914 | 12/1996 | Sinykin | 37/219 X |

FOREIGN PATENT DOCUMENTS

| | | | |
|---|---|---|---|
| 1097857 | 7/1955 | France | 172/519 |
| 470893 | 5/1969 | Switzerland | 37/219 |
| 1339188 | 9/1987 | U.S.S.R. | 37/219 |

*Primary Examiner*—Thomas B. Will
*Assistant Examiner*—Victor Batson
*Attorney, Agent, or Firm*—Norman M. Cameron

[57] ABSTRACT

A snow removal device and method includes a core having provision for adhering snow to the core. This includes recesses which receive packed snow. Snow to be removed contacts the packed snow and adheres to the core. The core is rolled on a portion of a surface covered with snow so the snow from the surface communicates with the packed snow, clings thereto and builds upon the surface of the member as the member is rolled.

1 Claim, 5 Drawing Sheets

CORE-TYPE SNOW REMOVER

BACKGROUND OF THE INVENTION

This invention relates to devices for removing snow, in particular using a core to which snow adheres.

Snow removal is a tedious task and frequently exhausting and even dangerous for elderly persons or persons with heart disease or other such problems. The conventional way of removing snow from steps, walkways and driveways is the use of a shovel to lift the snow and pile it to one side, or use a plow to push the snow from the portion of the surface which is to be snow-free. These plows may be simple manual devices with a curved blade and a handle attached thereto or can be large, heavy plows connected to vehicles.

Snowblowers are another conventional way of removing snow. Again, they may be relatively small powered units pushed by hand and typically used for residential walkways and driveways. Alternatively, they may be large units attached to vehicles for blowing large volumes of snow.

Small snowblowers are the main powered way of removing snow from residential walkways and driveways to reduce the effort associated with shoveling or using manual plows. These devices however are relatively expensive and are not within the budget of many persons. This is particularly true for areas where snow falls are relatively infrequent.

One particular type of snow presents more problems than most others. This is heavy, wet snow. Such snow typically accumulates in more temperate climates where the temperature at snowfall is near the freezing point. Shoveling or plowing such heavy, wet snow to one side is a particularly arduous task. Furthermore, most snowblowers are not effective with such heavy wet snow. They are more efficient when blowing relatively light, powder snow which accumulates at temperatures well below the freezing point.

Various rotary devices have been developed for plowing snow. An example is found in United States found in U.S. Pat. No. 4,829,684.

A manual snow removal device employing rotating members is disclosed in U.S. Pat. No. 4,920,667 to Dixon. In this case a handle is connected to an auger which is pushed through the snow. There is a blade adjacent the auger. Snow accumulating on the blade is moved to one side by the auger.

U.S. Pat. No. 4,024,654 discloses a snow scoop for removing snow from a sloping roof. This includes a blade which is C-shaped in section and mounted on rings at the ends thereof. A pulling device is connected to the rings.

Canadian Patent App. No. 2,095,399 discloses an apparatus for removing ice and snow which includes a plurality of flexible arms extending from a rotatable member.

Canadian Patent No. 2,113,260 discloses hand held powered rotary sweepers with belt mounted blades.

The prior art however does not provide a convenient way of removing heavy, wet snow from walkways, driveways and the like with minimal expenditure of effort, but requiring a relatively modest investment.

Accordingly, it is an object of the invention to provide an improved snow removal device which is capable of removing snow, particularly heavy wet snow, from surfaces.

It is also an object of the invention to provide an improved a snow removal device which requires relatively little effort from persons using the device.

It is a further object of the invention to provide an improved snow removal device which is simple and economical to produce and sell.

SUMMARY OF THE INVENTION

In accordance with these objects, there is provided, according to one aspect of the invention, a snow removal device which includes a core having means for adhering snow to the core. The means includes recesses which receive packed snow whereby additional snow adheres to the packed snow as the core is rolled over a surface to remove snow from the surface.

Preferably the core has a mesh-like member. The member may be of expanded metal.

For example, the core may have an axle, and a plurality of said members extending radially outwards from the axle and angularly spaced-apart.

In the preferred embodiment, the device has a handle, the core being rotatably mounted on the handle.

There is provided, according to another aspect of the invention, a method of snow removal. The method includes the steps of providing a member with spaced-apart apertures. Snow is packed about the member and through the apertures. The member is rolled over a portion of a surface covered with snow so the snow from the surface communicates with said packed snow, clings thereto and builds up on the surface of the member as the member is rolled.

Preferably snow is removed from the member at a location other than the portion of the surface.

The invention offers significant advantages over previously known devices and methods for snow removal. Snow, particularly heavy wet snow, can be removed from portions of surfaces which are to be snow-free without requiring the user to lift heavy shovels full of snow. The device and method can cope with snow which is very wet and cannot be dealt with efficiently using snowblowers. Furthermore, the device can be produced and sold at a modest price, making it attractive to many persons in climates where snow is not an everyday winter occurrence and for persons who do not have the resources to buy powered snowblowers.

BRIEF DESCRIPTION OF THE DRAWINGS

Referring to the drawings.

DESCRIPTION OF THE PREFERRED EMBODIMENTS

Figure 1:
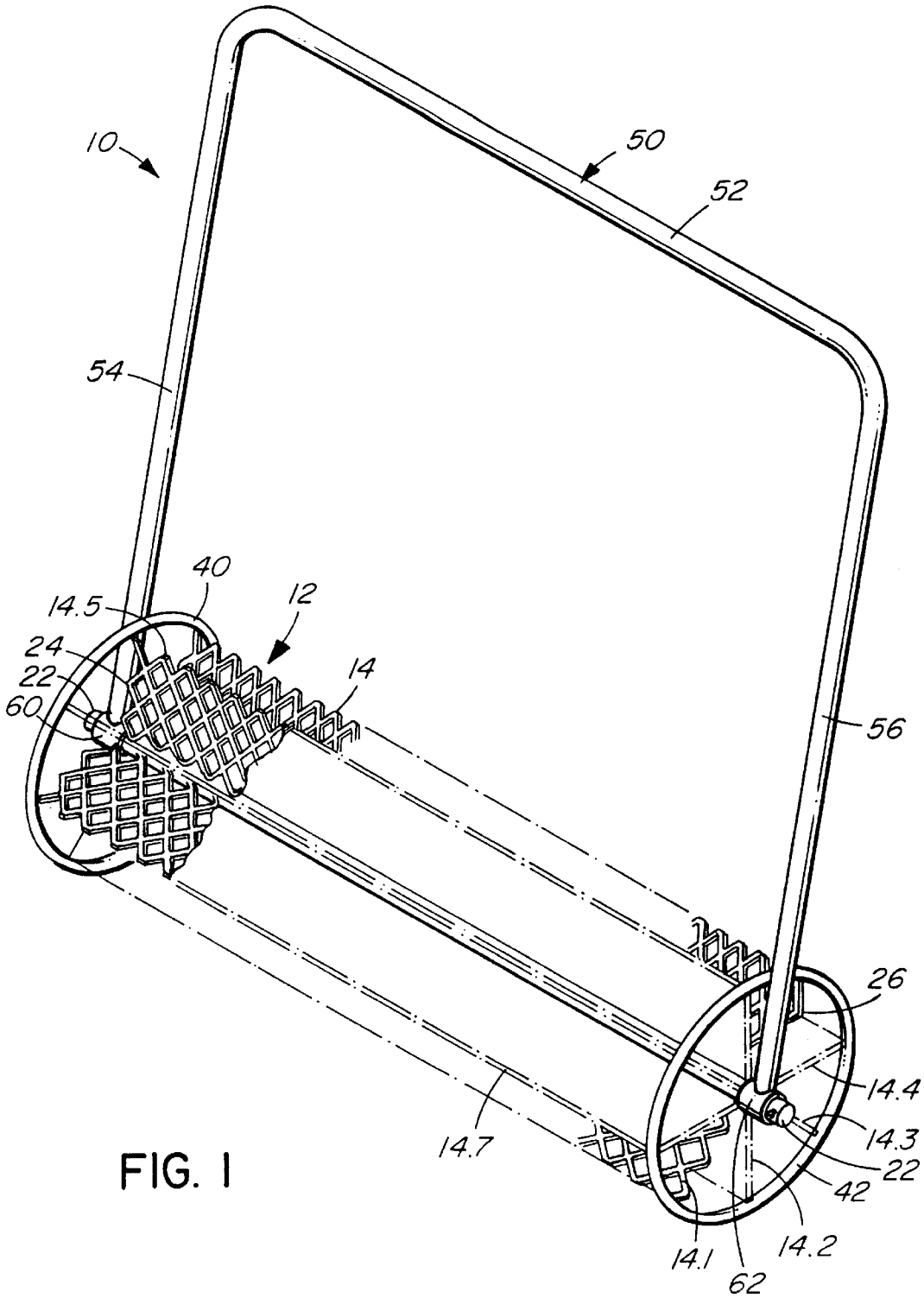
FIG. 1 is a top, front isometric view of a snow removal device according to an embodiment of the invention with some of the mesh-like members removed.
Figure 2:
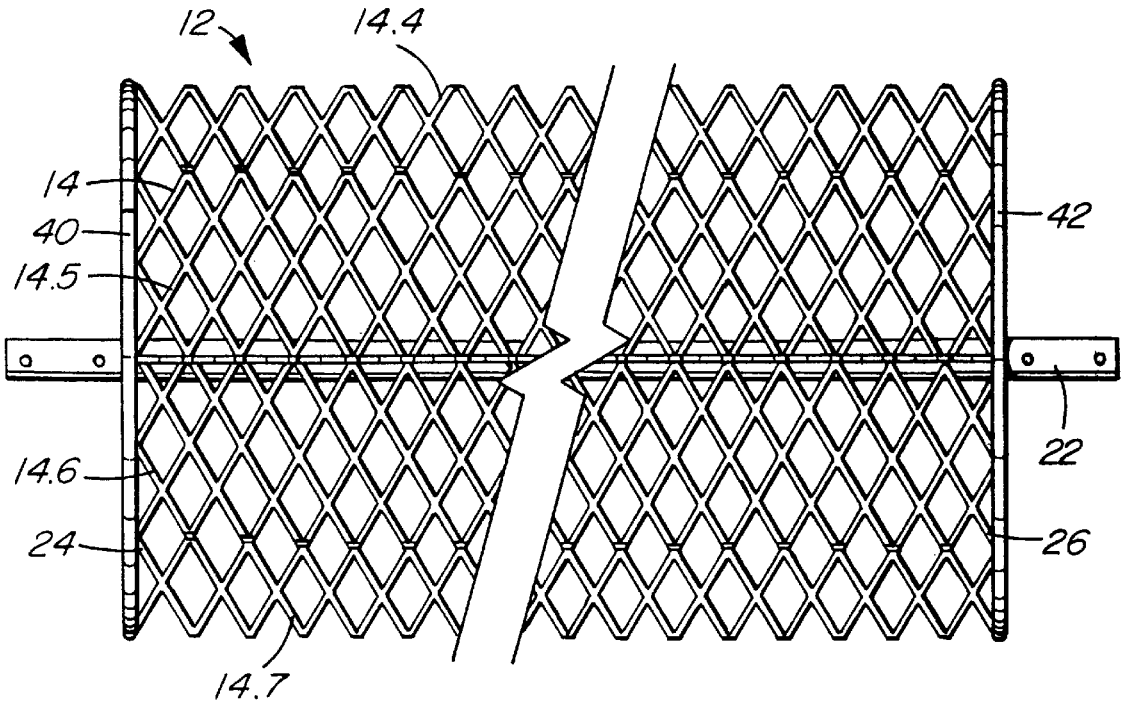
FIG. 2 is a front elevation of the core thereof.
Figure 3:
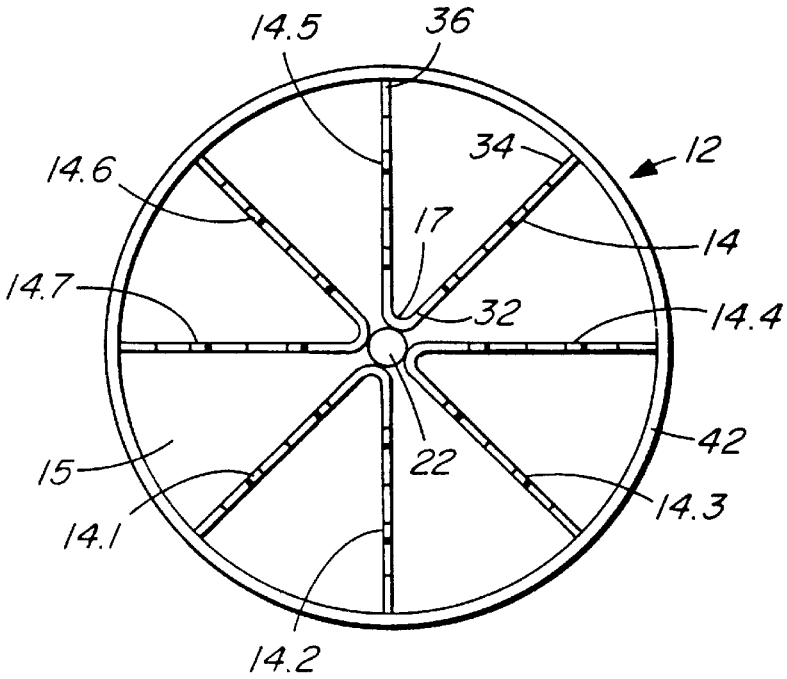
FIG. 3 is an end view of the core of FIG. 2.
Figure 8:
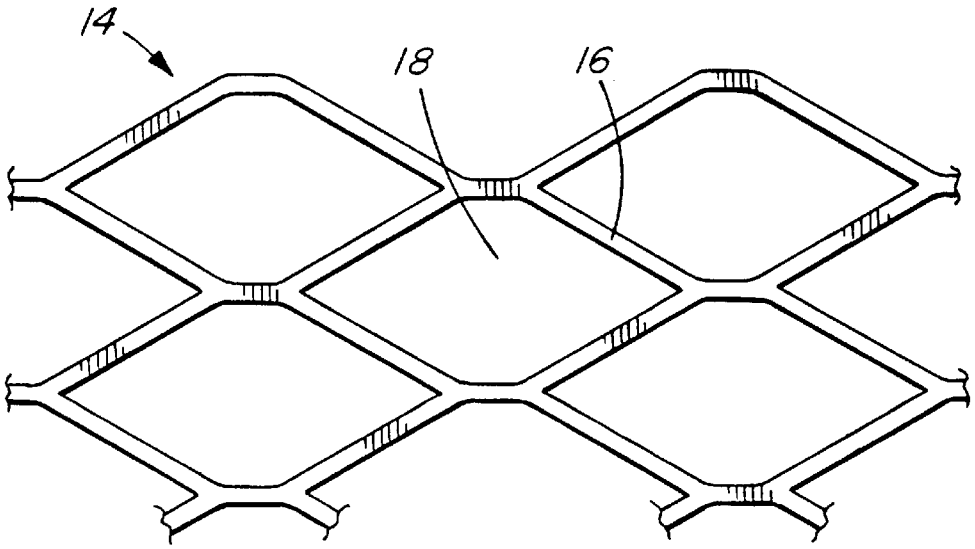
FIG. 8 is fragmentary, plan view of a portion of the mesh-like member of the core of FIG. 1–6.

Referring to the drawings, and first to FIG. 1, this shows snow removal device 10 according to an embodiment of the invention. The device includes a core shown generally at 12. The core includes a plurality of rigid mesh-like members 14, 14.1, 14.2, 14.3 and 14.4. In this particular embodiment, the members are made of expanded metal shown best in FIG. 8. Such expanded metal is commonly available and is typically used for slip resistance on floors and other such purposes. It includes wire-like elements 16 which extend about apertures 18. In this particular example the apertures are generally in the shape of parallelograms. It should be understood however that other rigid mesh-like members, of plastic for example, or other members having surface openings could be substituted. The device includes additional members 14.5, 14.6 and 14.7 which are shown in FIG. 3 but removed in FIG. 1 for clarity. The members are spaced-apart by V-shaped recesses 15 as seen best in FIG. 3.

An axle 22 extends centrally through the core 12 and outwardly beyond opposite ends 24 and 26 of the core. The members 14–14.7 are connected to the axle, by welding in this example, and are angularly spaced-apart approximately 45° from each other. In other embodiments the number of members and angle could vary. In this example the members are made up of four pairs of members, each pair having a V-shaped configuration as seen in FIG. 3, for example pair 14 and 14.5. These are connected to the axle at their vertex 17. Alternatively the members, or pairs of members could be connected directly together near the center of the core and the axle omitted.

The cylindrical shape of the core also maintained by two hoop-like members 40 and 42 located adjacent ends 24 and 26 of the core. These members are made of steel rod in this particular example although other materials could be substituted.

The device 10 includes a handle 50, which in this example is inverted U-shaped, and includes a portion 52 which is kept generally horizontal as the device is rolled over a surface. The handle has two spaced-apart legs 54 and 56 which are connected to sleeve-like bearing members 60 and 62 at ends thereof opposite portion 52. The members 60 and 62 fit rotatably over opposite ends of the axle 22.

Figure 7:
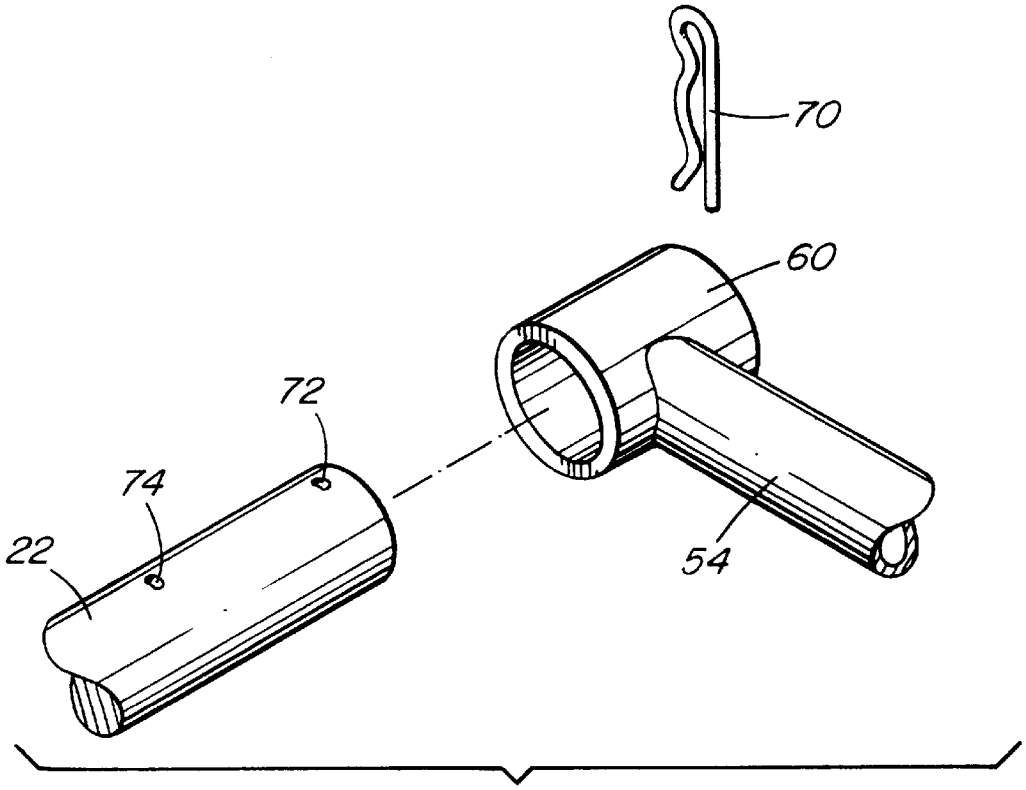
FIG. 7 is an exploded, fragmentary view of a portion of the handle and axle shown in FIG. 1 and 6.

Referring to FIG. 7, which shows how member 60 is connected to leg 54, each member 60 and 62 slides over one end of axle 22 and is held in place by a pair of cotter pins 70, only one of which is shown, fitted in apertures 72 and 74 of the axle located on opposite sides of the member 60 or 62 when the member is positioned on the axle.

OPERATION AND METHOD

The device works best if the recesses 15 are first filled with snow. Snow is scooped up and packed into the recesses and through apertures 18 which extend through the members 14–14.7 between the recesses. The core is preferably completely covered with snow.

Figure 4:
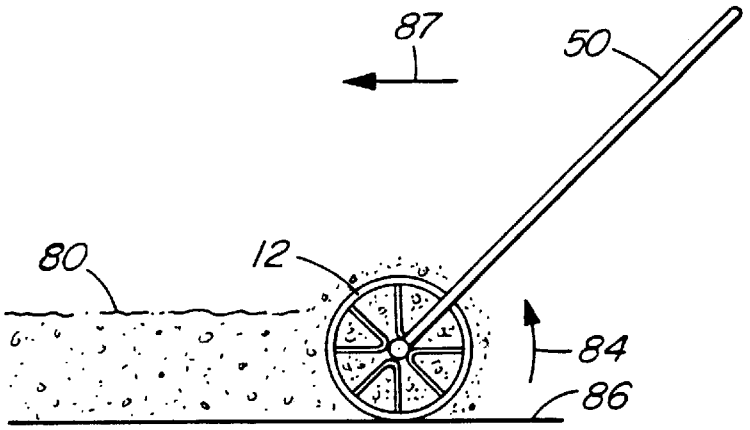
FIG. 4 is a simplified end view of the core being used to remove snow from a surface.

After the core has been filled with snow, it is placed on a surface which is covered with snow and which is desired to be snow-free. The core is then rolled in one direction or another over snow 80 accumulated on surface 82 as shown in FIG. 4. The core in this instance is rotated in the direction of arrow 84, leaving a snow-free surface 86 behind the roller.

The handle 50 however makes the device more convenient to use in many instances, particularly for controlling downhill movement. The handle is shown installed in FIG. 5. As the roller is pushed in direction 87 by handle 50, core 12, and snow 81 accumulating on the core 12 which rotates in the direction shown by arrow 88.

Figure 5:
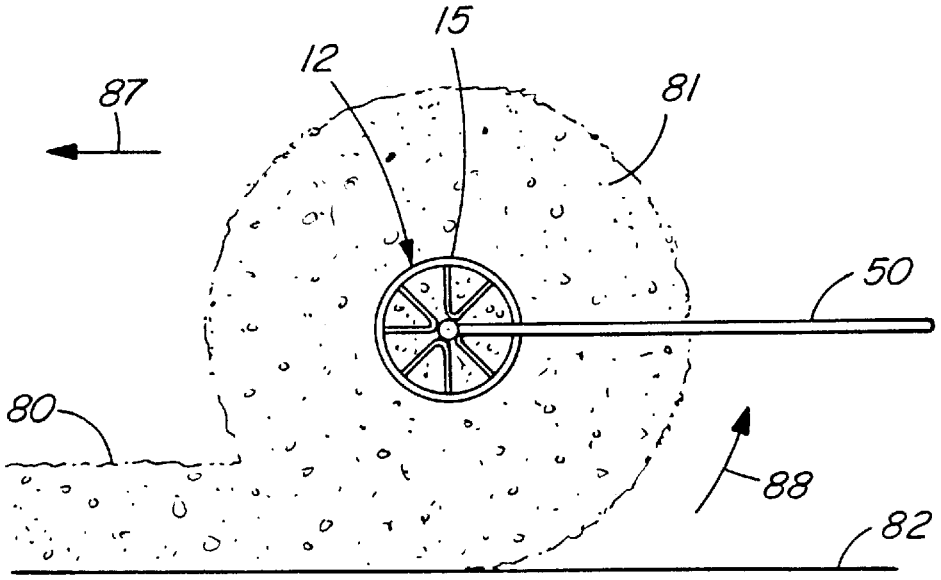
FIG. 5 is a view similar to FIG. 4 with a handle attached to the core and with a significant layer of snow built up on the core.
Figure 6:
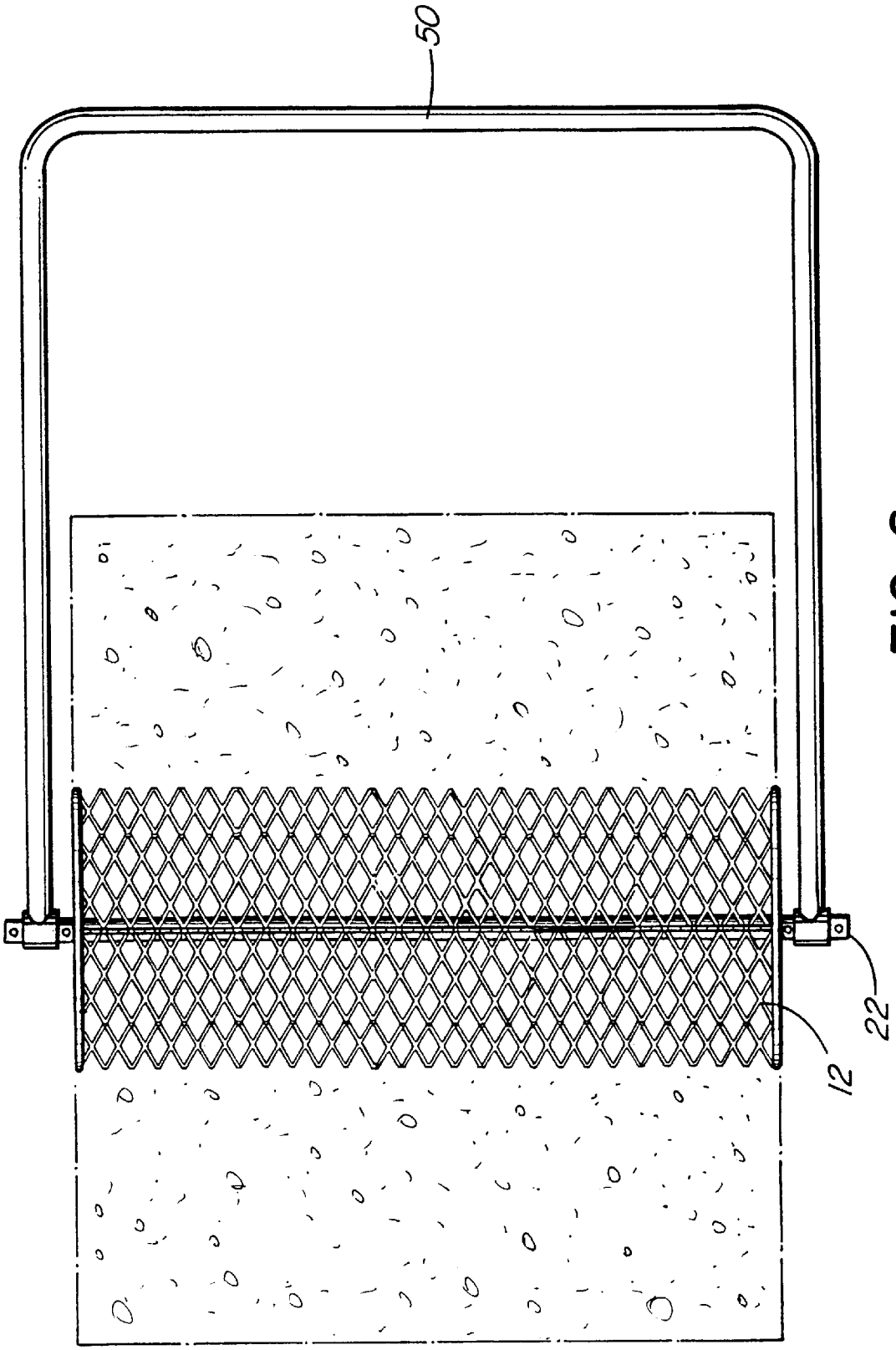
FIG. 6 is a top plan view of the core and snow shown in FIG. 5.

Snow accumulates on the core as the core rotates because snow tends to cling to itself. Thus the snow accumulating on core 12 communicates with and adheres to the snow packed on the core. Eventually the snow accumulating on the core builds up to a relatively large diameter, as shown in FIG. 5, whereby the core becomes heavy and difficult to move. When this occurs, the snow is removed from the core at a position which need not be snow-free. This can be done by removing the handle 50 from the axle (when the handle is employed) and then sliding core 12 axially out of the accumulated snow. This leaves behind a snow cylinder with a central aperture previously occupied by the snow-filled core.

It will be understood by someone skilled in the art that many of the details provided above are by way of example only and are not intended to limit the scope of the invention which is to be interpreted with reference to the following claims.

What is claimed is:

1. A method of snow removal, comprising the steps of:

providing a member with spaced-apart apertures;

packing snow about the member and through the apertures;

rolling the member over a portion of a surface covered with snow so the snow from the surface communicates with said packed snow, clings thereto and builds upon a surface of the member as said member is rolled; and removing the snow by axially pulling the member from the snow built upon the surface of the member.

* * * * *